US007549520B1

(12) United States Patent
Chen

(10) Patent No.: US 7,549,520 B1
(45) Date of Patent: Jun. 23, 2009

(54) SPRING STRUCTURE OF A MULTI-JOINT LUGGAGE PULL-ROD

(76) Inventor: Shou-Mao Chen, No. 344, Section 1, Chung Shan Road, Ta Cha Township, Taichung Hsien (TW)

( * ) Notice: Subject to any disclaimer, the term of this patent is extended or adjusted under 35 U.S.C. 154(b) by 572 days.

(21) Appl. No.: 11/477,009

(22) Filed: Jun. 29, 2006

(51) Int. Cl.
*A45C 13/26* (2006.01)

(52) U.S. Cl. ..... 190/115; 16/113.1

(58) Field of Classification Search ..... 190/115; 16/113.1

See application file for complete search history.

(56) References Cited

U.S. PATENT DOCUMENTS 6,026,543 A * 2/2000 Chen ..... 16/113.1
6,148,477 A * 11/2000 Cheng ..... 16/113.1
6,581,737 B2 * 6/2003 Wang ..... 190/115
6,609,271 B2 * 8/2003 Kuo ..... 16/113.1
7,207,085 B1 * 4/2007 Chen ..... 16/113.1
2003/0042092 A1 * 3/2003 Wang ..... 190/115
2006/0225981 A1 * 10/2006 Lin ..... 190/115

* cited by examiner

*Primary Examiner*—Tri M Mai
(74) *Attorney, Agent, or Firm*—Egbert Law Offices PLLC

(57) ABSTRACT

The spring structure of a multi-joint luggage pull rod is placed in the positioning base between the first and second joint tube of the pull rod. The spring structure includes top base, spring and bottom base. The top base includes a concave part, protruding joint, and spring limiting part. The protruding joint inserts in the through hole of the positioning base made by the second joint tube. The base includes a spring support and a prop, and the spring support is to be connected to the bottom of the spring. The prop can be pushed against the top of the positioning base made by the second joint tube. The spring structure for a multi-joint pull rod adds the top base, spring and bottom base for easy assembly, which does not have to change the internal structure of the pull rod to make the grip spring upward.

3 Claims, 7 Drawing Sheets

SPRING STRUCTURE OF A MULTI-JOINT LUGGAGE PULL-ROD

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a multi-joint luggage pull-rod, and more particularly to its spring structure.

BACKGROUND OF THE INVENTION

The pull-rods of common luggage in the market today usually have foldable structures, meaning that the pull-rods may be folded inside the luggage when not being used. The pull rod may be extended when being used. So as to make the outside of the luggage look nice, the grip of the pull-rod is usually hidden and lined up with the surface of the luggage when the pull-rod is folded inside the luggage. However, conventional luggage pull rods are not convenient because the luggage does not provide enough room for the user to grasp and pull the grip of the pull rod upward for use.

For these reasons, the industry developed a spring structure for a luggage pull-rod, as shown in FIG. 1. When the user desires to pull the grip 20 of the pull rod 10 upward, a press button 21 that is placed on the grip 20 can be pressed to make the first joint tube 11 spring upward to a predetermined distance. The internal structure, as shown in FIG. 2, includes a positioning base 110 placed at the bottom of the first joint tube 11, a spring 13 placed between the bottom of the positioning base 110, and a fixed base 120 of the second joint tube 12. The spring 13 is in a pressed state when it is pressed inside the first joint tube 11, and the positioning base 110 has a resilient jumping bean 111 that can be locked to the positioning hole 121 placed on the second joint tube 12 when protruding outward. The resilient jumping bean 111 has an oblique surface 112. When the button 21 on the grip is pressed down, a braking base 14 of the first joint tube 111 is driven downward at the same time. An oblique edge at the bottom of the braking base 14 touching the oblique surface 112 is made, and the resilient jumping bean 111 springs are driven inward. Once the resilient jumping bean 111 breaks off from the positioning hole 121, the first joint tube 11 is released, and springs up to a predetermined height, as shown in the right figure of the FIG. 2. Because of the restoring force of the spring 13, the grip 20 shown in FIG. 1 is placed in a uplifting position.

The spring structure of the luggage pull-rod is made from a two-joint structure. However, to meet the demand of a high tech user, the luggage industry has developed luggage especially for laptops. Because the height of this type of luggage is lower than regular luggage, the number of joints increases accordingly (3-5 joints). With this type of multi-joint pull-rod, the joints must interact; therefore, this structure is more complicated than the two-joint pull-rod mentioned above. The second joint tube of the multi-joint pull-rod must allow the first joint tube to slide down continually. For these reasons, its internal part cannot be placed on the fixed base mentioned above. Therefore, the spring structure of the two-joint pull-rod cannot be applied to the multi-joint pull-rod. However, there are still some issues, such as inconvenient operation when the grip mentioned above is hidden inside. Multi-joint pull-rods need further effort on the industry's part to make a break through.

Thus, to overcome the aforementioned problems of the prior art, it would be an advancement in the art to provide an improved structure that can significantly improve efficacy.

To this end, the inventor has provided the present invention of practicability after deliberate design and evaluation based on years of experience in the production, development and design of related products.

BRIEF SUMMARY OF THE INVENTION

The present invention is a spring structure, which includes a top base, a spring, and a bottom base to provide a structure that is applicable for a multi-joint pull-rod. The structure is assembled by adding the top base 70, spring 60 and bottom base 80 to the positioning base 50 50B at the first and second joint tube 31 32. The structure does not even have to change the internal structure of the multi-pull rod. The press button 41 of the grip is simply pressed down to make the first joint tube 31 spring upward to a height to be practical, greatly reducing the cost needed for a multi-joint pull rod to meet the preferred effect.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 2:
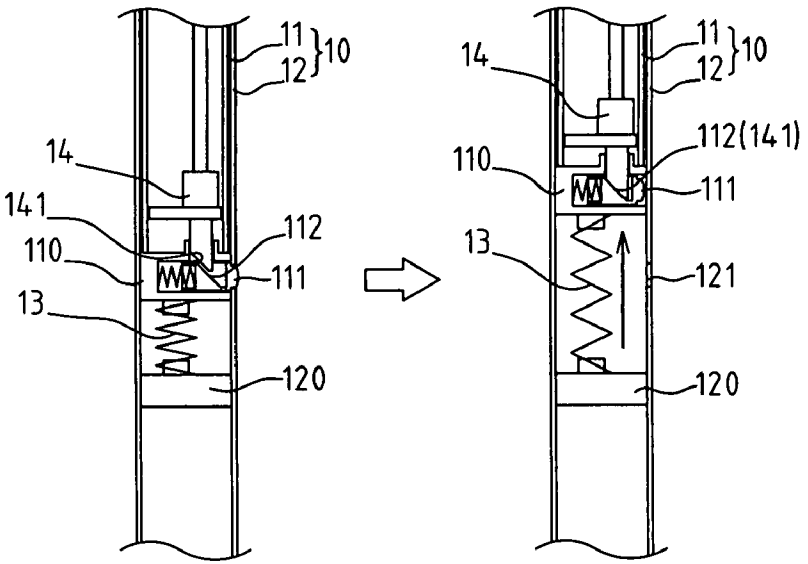
FIG.2 PRIOR ART
FIG. 2 shows a longitudinal sectional view of the pull-rod of the conventional luggage.
Figure 1:
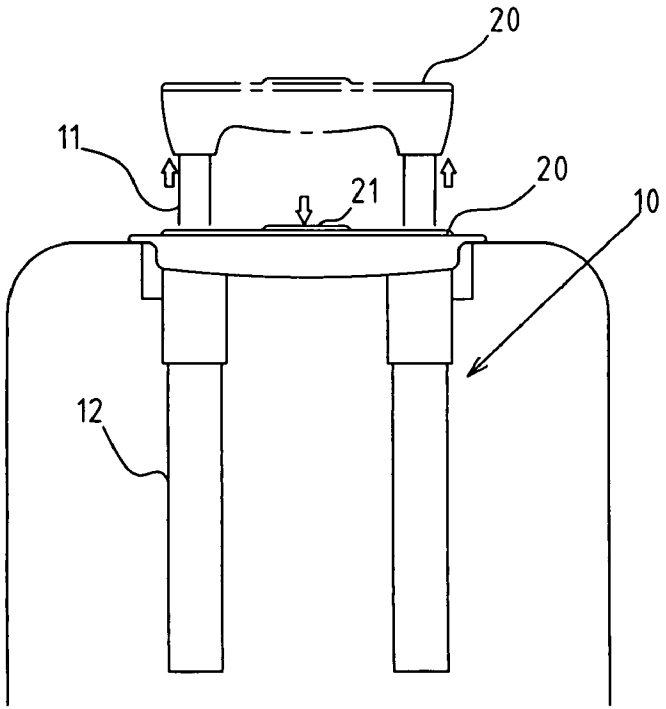
FIG.1 PRIOR ART
FIG. 1 shows an elevation view of the pull-rod of the conventional luggage.
Figure 3:
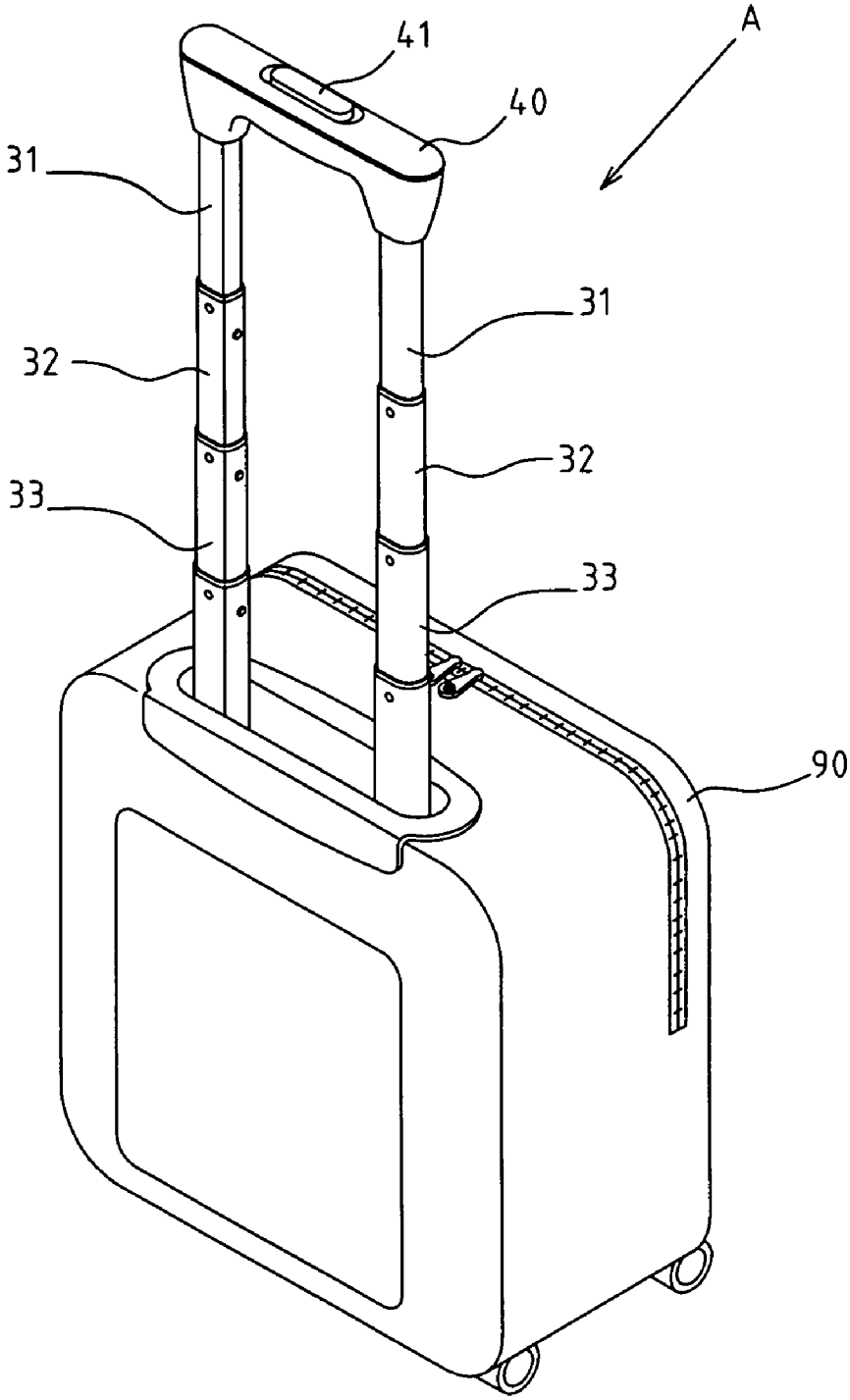
FIG. 3 shows a perspective view of the multi-joint luggage pull-rod of the present invention that is connected to the luggage, with the pull-rod extended.
Figure 4:
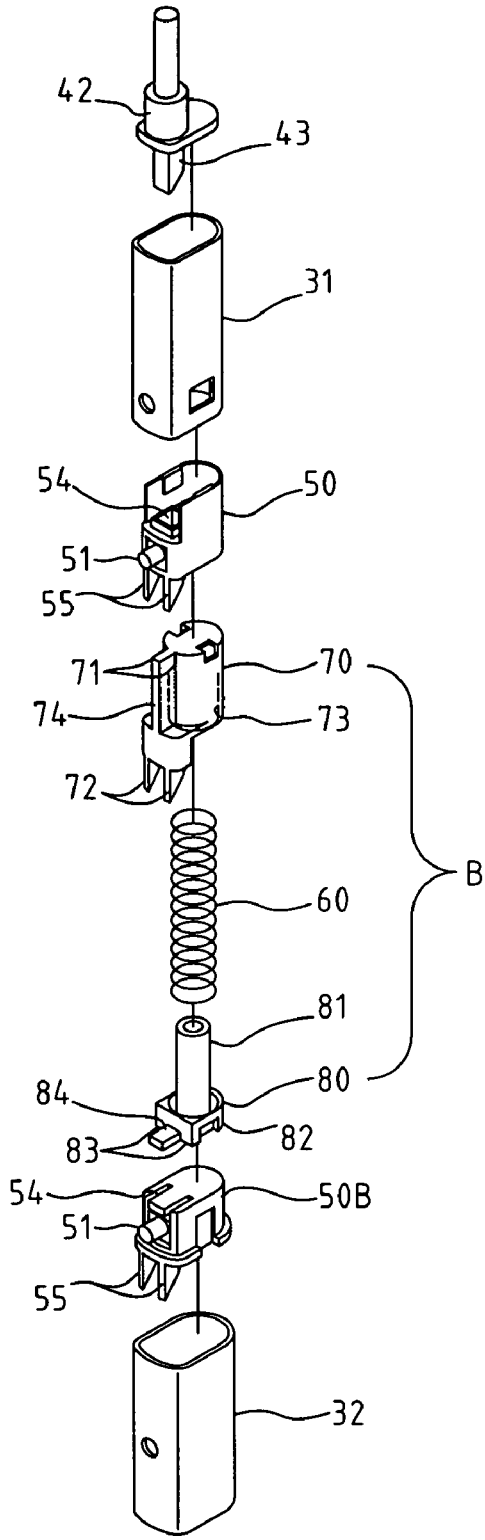
FIG. 4 shows an exploded perspective view of the main components of the present invention.
Figure 5:
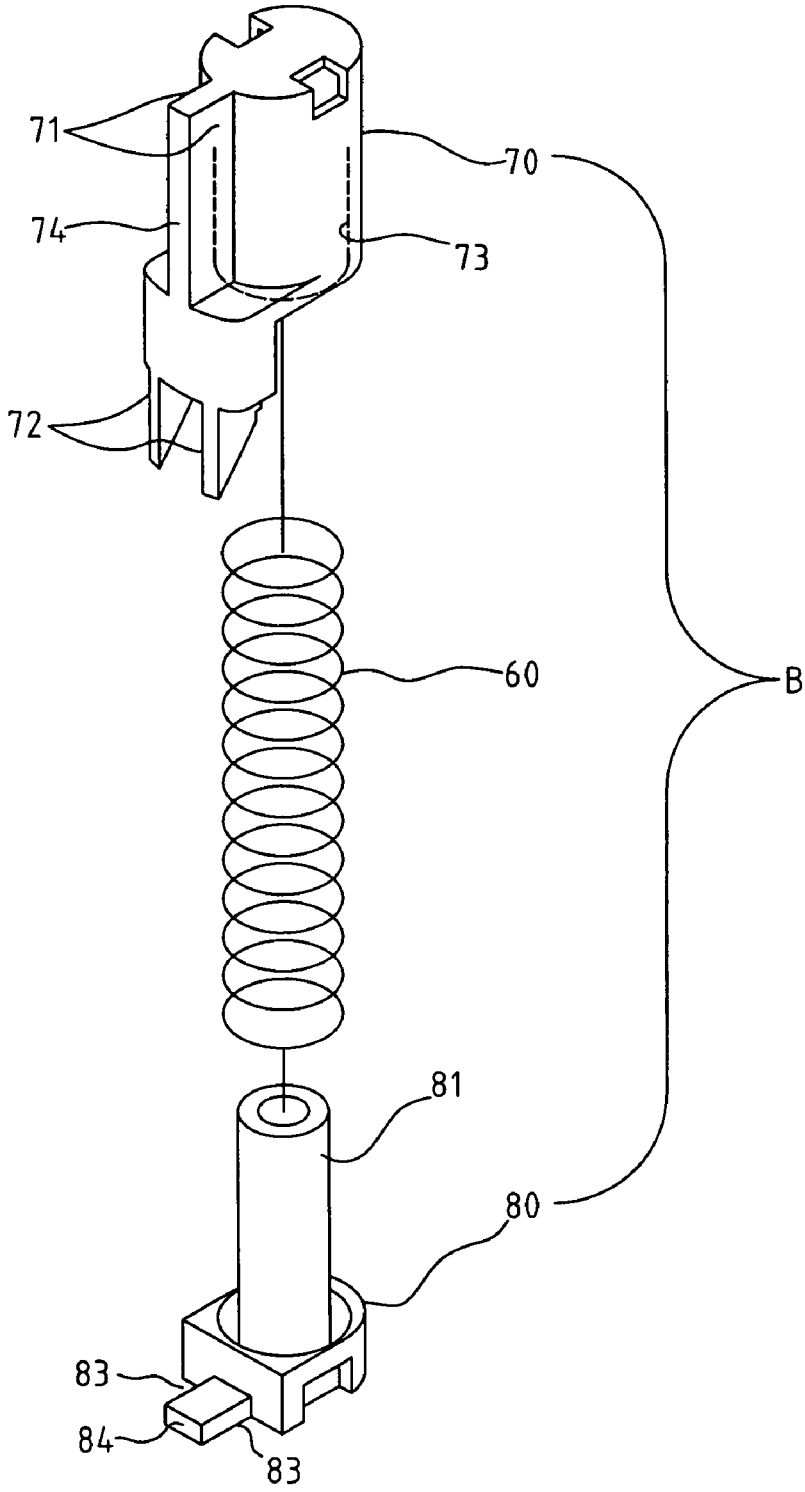
FIG. 5 shows an exploded perspective view of the spring structure of the present invention.

The features and the advantages of the present invention will be more readily understood upon a thoughtful deliberation of the following detailed description of a preferred embodiment of the present invention with reference to the accompanying drawings.

As shown in FIGS. 3, 4, 5, 6, 7, there is the preferred embodiment of an improved spring structure of a multi-joint pull rod of the present invention. The multi-joint luggage pull-rod A comprises at least three joint tubes 31, 32, 33, and a grip 40. A press button 41 is placed on the grip 40. When the press button 41 is pressed down, a braking base 42 on the first joint tube 31 is driven downward at the same time. An oblique joint 43 is placed at the bottom of the braking base 42, and a positioning base 50, 50B is placed at the bottom of the joint tubes 31, 32, 33. A resilient jumping bean 51 and resilient spring 52 are placed in the positioning base 50, 50B, and an oblique surface 53 is placed on the predetermined part of the resilient jumping bean 51. A through hole 54 and protruding foot 55 are placed on the top and bottom of the positioning base 50. The through hole 54 of the positioning base 50 placed at the bottom of the joint tube 31 can be inserted by the oblique joint 43 at the bottom of the joint tube 31. By so doing, the oblique surface 53 of the positioning base 50 is pushed to make the resilient jumping bean 51 spring inward. The spring structure B is placed inside the positioning base 50 made by the first and second joint tube 31, 32.

The spring structure B includes a spring 60.

The spring structure B also includes a top base 70. The top base 70 includes a concave part 71, a protruding joint 72, and a spring limiting part 73. The concave part 71 connects to the protruding foot 55 of the positioning base 50 by the first joint tube 31. The protruding joint 55 inserts in the through hole 54 of the positioning base 50B made by the second joint tube 32. The spring limiting part 73 is connected to the top end of the spring 60.

A base 80 includes a spring support 81 and a prop 82, and the spring support 81 is to be connected to the bottom of the spring 60. The prop 82 can be pushed against the top of the positioning base 50B made by the second joint tube 32. A yielder 83 is placed on one side of the base 80 for the protruding joint 72 of the top base 70 to go through.

The spring limiting part 73 of the top base 70 can be a slot. The spring support 81 of the base 80 can be a protruding rod.

The protruding foot 55 of the positioning base 50, 50B. The protruding joint 72 of the top base 70 can have a spaced double-legged structure, so that the concave part 71 of the top base 70 corresponds to the protruding foot 55 of the positioning base 50 for the first joint tube 31. A protruding rib 74 is formed in the middle. The yielder 83 is placed at the base 80 corresponding to the protruding joint 72 of the top base 70, and a protruding block 84 is formed in the middle.

Through the above structure and design, the assembly and operation of the present invention is explained herein.

The core of the present invention is the spring structure B. When assembled during the assembly process of the first joint tube 31 and joint tube 32, the procedure is to place the base 80 of the spring structure, spring 60, and the top base 70 inside the positioning base 50, 50B of the first and second joint tube 31 32. The original structure of the multi-joint pull-rod does not need to change, which means that the spring structure B can be added to the multi-joint pull-rods. If the spring structure B is not added, the original function of the multi-joint pull rod can still be operating normally, but without the spring action.

Figure 6:
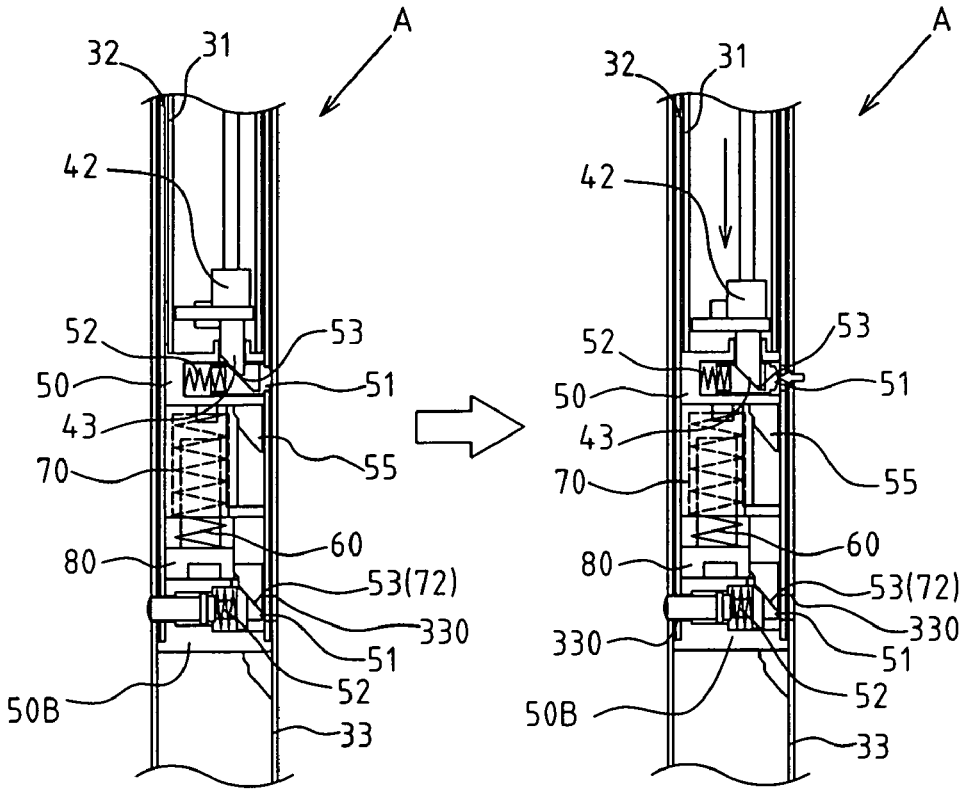
FIG. 6 shows a longitudinal sectional view of the internal structure of the springing movement of the pull-rod of the present invention.
Figure 7:
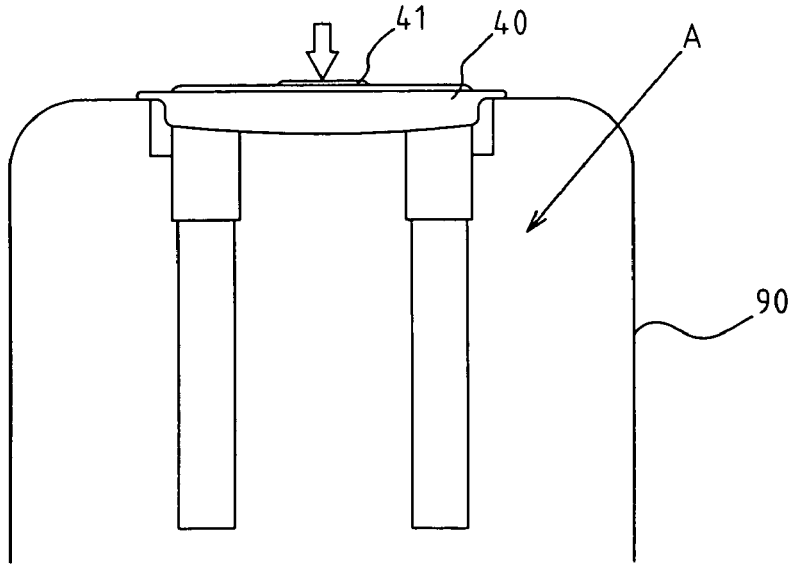
FIG. 7 shows an elevation view of the pull-rod grip of FIG. 6.

As shown in the left figure of the FIG. 6 and FIG. 7, when the pull-rod A of the multi-joint luggage is hidden inside the luggage 90, the resilient jumping bean 51 of the positioning base 50 of the first joint tube 31 can be locked into a positioning hole 320 of the second joint tube 32. On the other hand, the resilient jumping bean 51 of the positioning base 50B of the second joint tube 32 can be locked into a positioning hole 330 on the third joint tube 33. At this time, the top base 70 and the bottom base 80 of the spring structure B can be pressed by the top and bottom positioning base 50, 50B, making the spring 60 in the middle in the pressed condition accumulate restoring force. At this time, the protruding foot 55 of the positioning base 50 of the first joint tube 31 can be inserted to the concave part 71 of the top base 70, and the protruding joint 72 of the top base 70 goes through the yielder 83 of the bottom base 80, further pushing the oblique surface 53 of the resilient jumping bean 51 of the positioning base 50B placed on the second joint tube 32.

Figure 9:
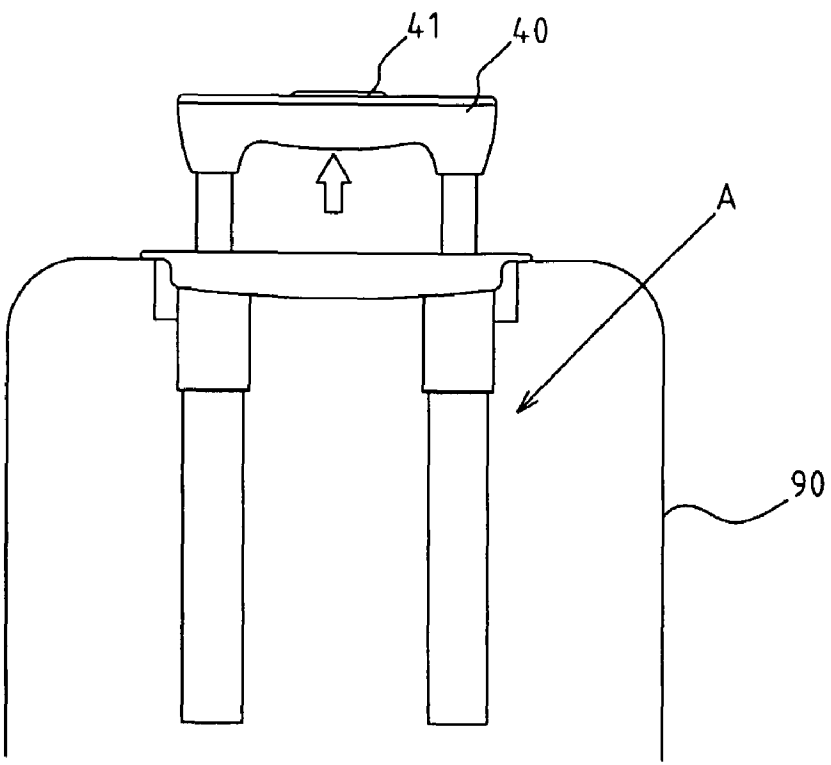
FIG. 9 shows another elevation view of the pull-rod grip of the present invention.
Figure 8:
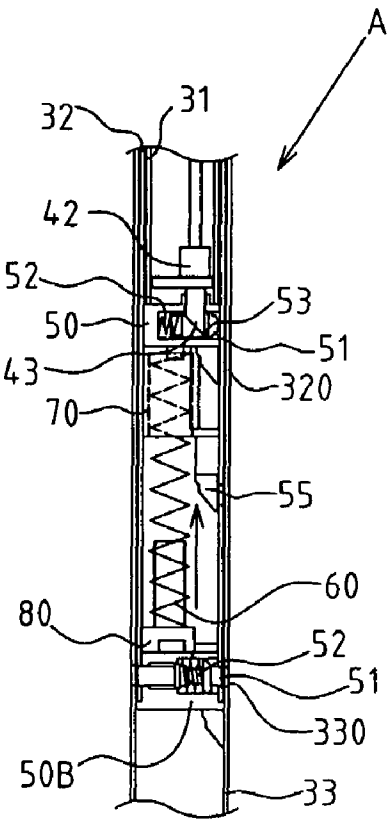
FIG. 8 shows the second longitudinal sectional view of the internal structure of the springing movement of the pull-rod of the present invention.
Figure 10:
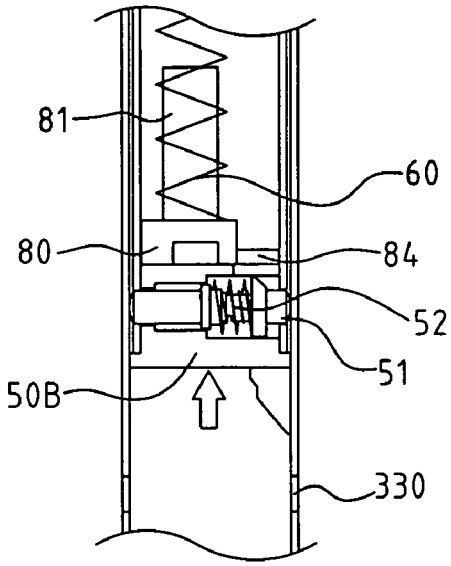
FIG. 10 shows the third longitudinal sectional view of the internal structure of the springing movement of the pull-rod of the present invention.
Figure 11:
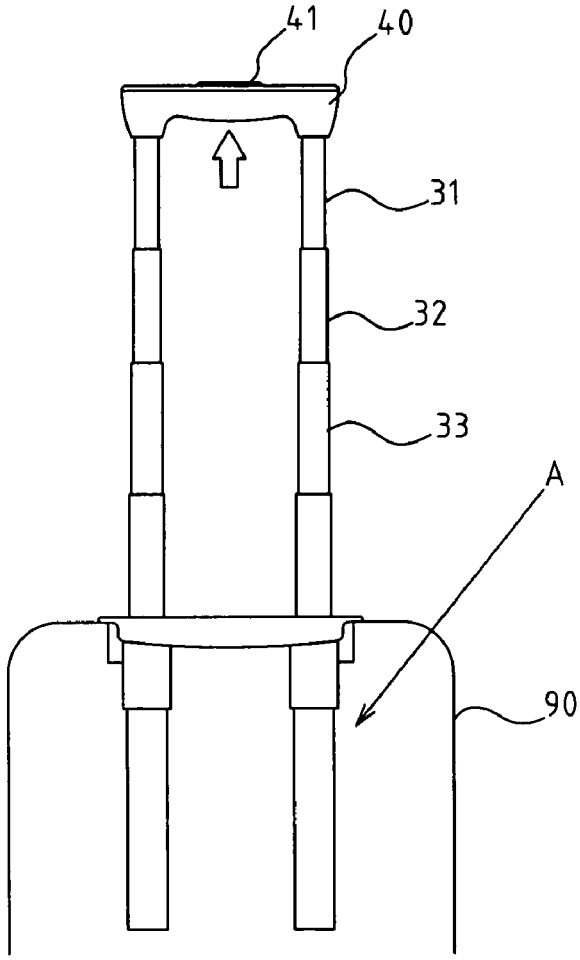
FIG. 11 shows an elevation view of the pull-rod grip corresponding to FIG. 10.

Next, as shown in the right figure of FIG. 6 and FIG. 7, when user presses the press button 41 on the grip 40, the braking base 42 of the first joint tube 31 is driven down at the same time. The oblique joint 43 at the bottom of the braking base 42 pushes against oblique surface 53 of the positioning base 50 at the first joint tube 31 and presses the resilient jumping bean 51 inward. The oblique joint 43 breaks off from the positioning hole 320 of the second joint tube 32. At this time, the first joint tube 31 is released and springs upward in a predetermined height, as shown in FIG. 8, by the restoring force of the spring 60 of the spring structure B. The grip 40 is made to spring upward to a predetermined height, as shown in FIG. 9, for the convenience of a user's hands. Moreover, when the spring 60 is released, as shown in FIG. 8, it pushes the top base 70 upward, and it makes its protruding joint 72 break off from the oblique surface 53 of the positioning base 50B at the second joint tube 32. By so doing, the resilient jumping bean 51 can break off from the positioning hole 330 of the second joint tube 33 automatically, as shown in FIG. 10. The principle of the resilient jumping bean 51 is achieved through the internal structure of the conventional positioning base; therefore, it is not repeated here. The second joint tube 32 is also in released condition, and it can be extended upward. The structure of multi-joint pull-rod A is extended by the same principle, as shown in FIG. 11.

I claim:

1. A spring structure of a multi-joint luggage pull-rod, the pull-rod comprising at least three joint tubes and a grip, said grip having a press button placed thereon, the joint tubes having a bottom with a positioning base placed thereon, said positioning base having a resilient jumping bean and resilient spring placed therein, said resilient jumping bean having an oblique surface placed on a predetermined part thereof, said positioning base having a through hole and a protruding foot placed on a top and bottom thereof respectively, said spring structure being placed inside said positioning base made by the first and second joint tubes, said spring structure comprising:

a spring; and a top base, being comprised of a concave part, a protruding joint, and a spring limiting part, said concave part connecting to said protruding foot of said positioning base by the first joint tube, said protruding joint being inserted in said through hole of said positioning base made by the second joint tube, said spring limiting part being connected to a top end of said spring; and a base, being comprised of a spring support and a prop, said spring support being connected to a bottom of said spring, said prop being pushed against a top of said positioning base made by the second joint tube, said base having a yielder placed on one side of said base for said protruding joint of said top base to go through.

2. The structure defined in claim 1, wherein said spring limiting part of said top base is a slot, said spring support of said base being a protruding rod.

3. The structure defined in claim 1, wherein said protruding foot of said positioning base and said protruding joint of said top base are a spaced double-legged structure, said concave part of said top base corresponding to said protruding foot of said positioning base for the first joint tube, a protruding rib being formed in a middle thereof, said yielder being placed at said base corresponding to said protruding joint of said top base, a protruding block being formed in a middle thereof.

* * * * *